US010135115B2

(12) United States Patent
Shih et al.

(10) Patent No.: US 10,135,115 B2
(45) Date of Patent: Nov. 20, 2018

(54) INTEGRATED MODULE HAVING ANTENNA

(71) Applicant: HONGBO WIRELESS COMMUNICATION TECHNOLOGY CO., LTD., Taipei (TW)

(72) Inventors: Yu-Lin Shih, Taipei (TW); Kuan-Wei Lee, Taipei (TW); Yao-Yuan Chang, Taipei (TW); Tsung-Wen Chiu, Taipei (TW)

( * ) Notice: Subject to any disclaimer, the term of this patent is extended or adjusted under 35 U.S.C. 154(b) by 49 days.

(21) Appl. No.: 15/371,110

(22) Filed: Dec. 6, 2016

(65) Prior Publication Data

US 2017/0309990 A1 Oct. 26, 2017

(30) Foreign Application Priority Data

Apr. 26, 2016 (TW) ..... 105112884 A

(51) Int. Cl.

| | |
|---|---|
| ***H01Q 1/22*** | (2006.01) |
| ***H01Q 5/35*** | (2015.01) |
| ***H01Q 5/371*** | (2015.01) |
| ***H01Q 9/42*** | (2006.01) |
| ***H01Q 9/04*** | (2006.01) |
| ***H01Q 1/44*** | (2006.01) |

(Continued)

(52) U.S. Cl.

CPC ..... *H01Q 1/2266* (2013.01); *H01Q 1/44* (2013.01); *H01Q 5/35* (2015.01); *H01Q 5/371* (2015.01); *H01Q 7/00* (2013.01); *H01Q 9/0421* (2013.01); *H01Q 9/42* (2013.01); *H01Q 21/28* (2013.01); *H01Q 21/29* (2013.01)

(58) Field of Classification Search

CPC ..... H01Q 1/2266; H01Q 5/35; H01Q 5/371; H01Q 9/42; H01Q 9/0421

See application file for complete search history.

(56) References Cited

U.S. PATENT DOCUMENTS 6,515,629 B1 * 2/2003 Kuo ..... H01Q 1/38 343/700 MS 7,561,111 B2 7/2009 Yu (Continued)

FOREIGN PATENT DOCUMENTS

TW 201448349 A 12/2014

*Primary Examiner* — Robert Karacsony

(74) *Attorney, Agent, or Firm* — OPES IP Consulting Co. Ltd.

(57) ABSTRACT

An integrated module having an antenna comprises a module substrate, a camera module and the antenna disposed on the module substrate. The antenna comprises a grounding portion connected to ground plane, a low-frequency radiating arm, a high-frequency radiating arm, a feed-in line and a shorting portion. A connection portion of the low-frequency radiating arm and a connection portion of the high-frequency radiating arm are connected to the grounding portion. A free-end portion of the high-frequency radiating arm and a free-end portion of the low-frequency radiating arm are back-to-back and extend towards opposite directions. The feed-in line is perpendicular to an edge of the ground plane and extends away from the ground plane. The feed-in line crosses and connects the high-frequency radiating arm to provide a second feeding-point. The end of the feed-in line is connected to the connection portion of the low-frequency radiating arm to provide a first feeding-point.

10 Claims, 9 Drawing Sheets

(51) Int. Cl.

| | |
|---|---|
| ***H01Q 7/00*** | (2006.01) |
| ***H01Q 21/28*** | (2006.01) |
| ***H01Q 21/29*** | (2006.01) |

(56) References Cited

U.S. PATENT DOCUMENTS

| | | | | |
|---|---|---|---|---|
| 2004/0017319 | A1* | 1/2004 | Wang | G06F 1/1616 343/702 |
| 2014/0078008 | A1* | 3/2014 | Kang | H01Q 5/35 343/702 |
| 2015/0029071 | A1* | 1/2015 | Hwang | H01Q 9/42 343/845 |

* cited by examiner

INTEGRATED MODULE HAVING ANTENNA

CROSS-REFERENCE TO RELATED APPLICATIONS

This non-provisional application claims priority under 35 U.S.C. § 119(a) on Patent Application No(s). 105112884 filed in Taiwan (R.O.C.) on Apr. 26, 2016, the entire contents of which are hereby incorporated by reference.

BACKGROUND

Technical Field

The disclosure relates to an antenna, and more particularly to an integrated module having an antenna.

Related Art

Please refer to FIG. 1 through FIG. 4. Conventionally, the embedded antenna designs for electronic device such as laptop may be categorized into the following types according to the location for disposing the antenna. In the design of FIG. 1, one or more antennas 2*a* and 2*b* are disposed at the upper edge of the screen of the laptop so as to achieve a good radiation pattern with less interference of noise for the simple surrounding of the antenna. Here, the antenna 2*a* and the antenna 2*b* are connected to the wireless module 1 via the co-axial cable 3*a* and co-axial cable 3*b*, respectively. However, the attenuation of the design may be severe because the length of each of the co-axial cables 3*a* and 3*b*. Further, the way of assembling the wires from the co-axial cable 3*a* and the co-axial cable 3*b* to the wireless module 1 is complicated.

In the design in FIG. 2, antenna 2*a* and antenna 2*b* are disposed around the hinge under the screen. Compared with FIG. 1, the way for disposing the antenna in FIG. 2 may reduce the length of each of the co-axial cable 3*a* and 3*b* so as to reduce the loss of the radiofrequency signal and leave more space for the graph or symbol of the brand. However, the installation of the antenna in FIG. 2 results in bad radiation pattern and the antenna suffers from the interference. Further, the specific absorption rate (SAR) according to safety specifications is also a problem to be considered.

Then, according to the design in FIG. 3, the antennas 2*a* and 2*b* are disposed on the two lateral surface of the keyboard, so it suffers from more interference compared with the aforementioned designs and its efficiency of the antenna is worse. Further, the SAR according to the safety specifications needs to be further considered.

Then, please refer to the design in FIG. 4, the antennas 2*a* and 2*b* are integrated with the wireless module 1 and installed in the hinge of the laptop, and the wireless module 1 is connected to the system via the digital signal line 3*c*. Further, the camera module 4 disposed in center of the upper edge of the screen is connected to the system via the digital signal line 5. The installation makes the antenna suffer from more noise interference and have worse efficiency compared with the aforementioned designs. The SAR problem according to the safety specifications still needs to be considered. Although the antennas 2*a* and 2*b* are integrated with the wireless module 1 so there is no need for co-axial cable and the loss of the radiofrequency signal is reduced, it is still needed to connect the camera module 4 to the system via the digital signal line 5. The camera module 4 and the wireless module 1 are separated from each other and the digital signal lines they used are separated from each other as well.

Further, the trend of the design of the laptop or the terminal device is to reduce the non-necessary volume and to remove the non-necessary component to reduce the weight. On the contrary, the bandwidth provided by the antenna needs to be larger to meet the application of high-speed transmission or a variety of broadband application. Hence, in the condition that the space in a laptop for an antenna is narrower and more bandwidth is needed, the manufacturer needs to modify the structure of the antenna 2*a* and the antenna 2*b* to meet the specification when the antenna is applied in different laptop. Therefore, it is expectable that the antenna for different laptop is different in convention, and the manufacturer needs to make the specified antenna structure for each type of laptop. Different embedded antenna structure is needed for different laptop, and the cost of manufacture is difficult to be reduced.

SUMMARY

One embodiment of the disclosure provides an integrated module having an antenna including a module substrate, a camera module and a first antenna. The camera module is disposed on the module substrate and has a camera. The first antenna is disposed on the module substrate. The first antenna includes a first grounding portion, a first low-frequency radiating arm, a first high-frequency radiating arm, a first feed-in line, and a first shorting portion. The first grounding portion is connected to a first side of the ground plane. The first low-frequency radiating arm has a first connection portion and a first free-end portion, wherein the first connection portion is connected to the first grounding portion. The first high-frequency radiating arm has a second connection portion and a second free-end portion, wherein the second connection portion is connected to the first grounding portion, and the second free-end portion of the first high-frequency radiating arm and the first free-end portion of the first low-frequency radiating arm are back-to-back and extending to opposite directions. The first feed-in line is perpendicular to the first side of the ground and extending to a direction away from the ground plane to provide the first feeding-point and the second feeding-point. The first feed-in line is cross and connected to the second connection portion of the first high-frequency radiating arm to provide the second feeding-point, and an end of the first feed-in line is connected to the first connection portion of the first low-frequency radiating arm to provide the first feeding-point. The first shorting portion has a first terminal and a second terminal. The first terminal of the first shorting portion is connected to the junction between the first free-end portion and the first connection portion of the first low-frequency radiating arm, and the second terminal of the first shorting portion is connected to a junction between the second free-end portion and the second connection portion of the first high-frequency radiating arm.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
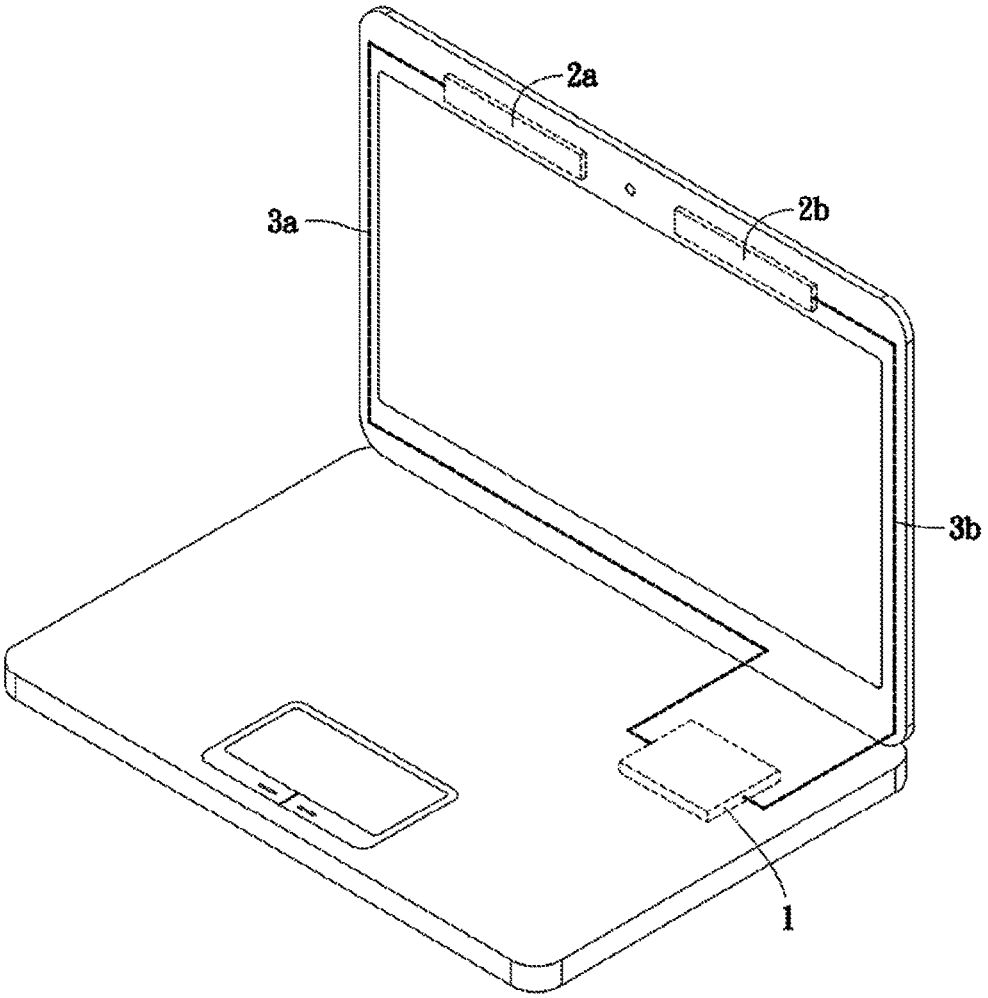
FIG.1 (PRIOR ART)
FIG. 1 is a schematic of a conventional embedded antenna for laptop.
Figure 2:
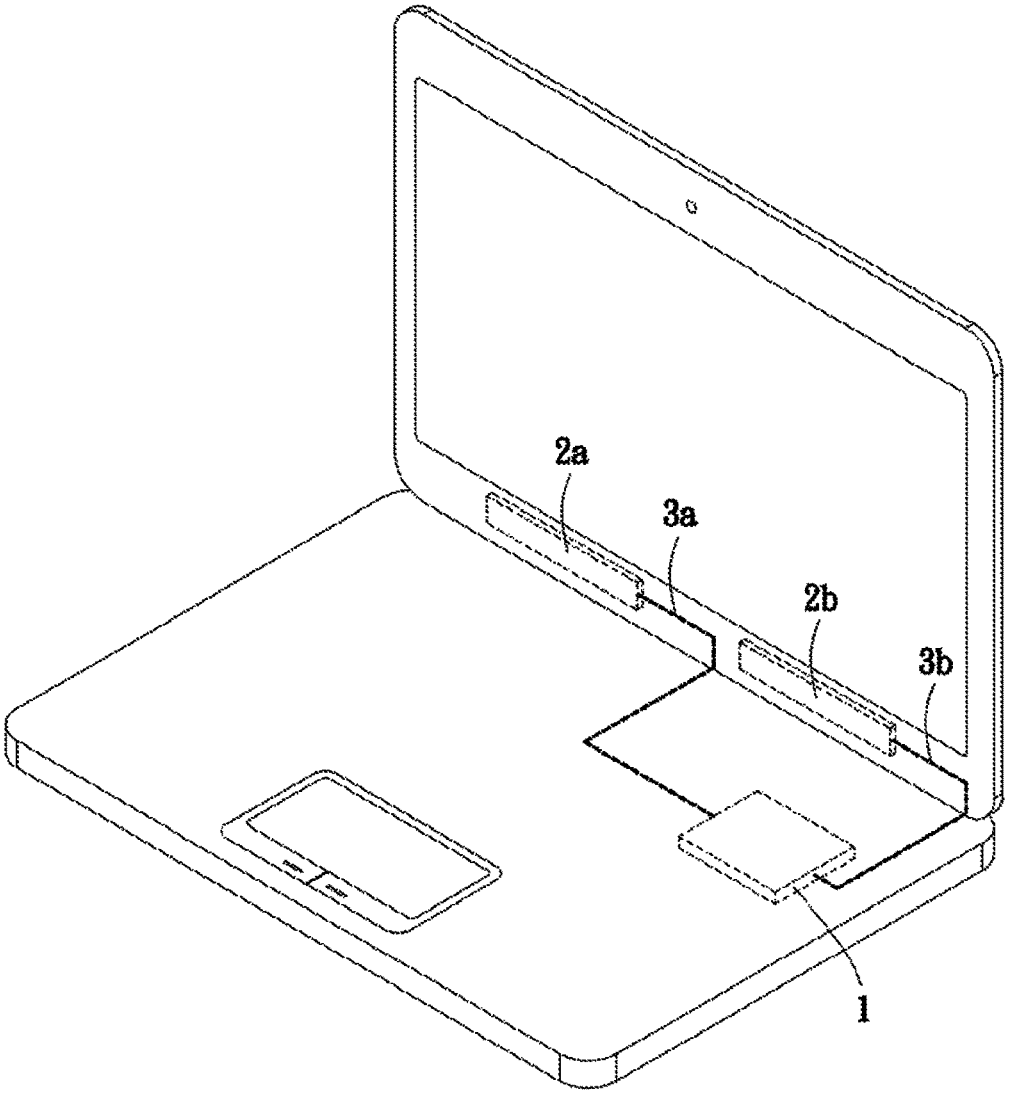
FIG. 2 (PRIOR ART)
FIG. 2 is a schematic of a conventional embedded antenna for laptop.
Figure 3:
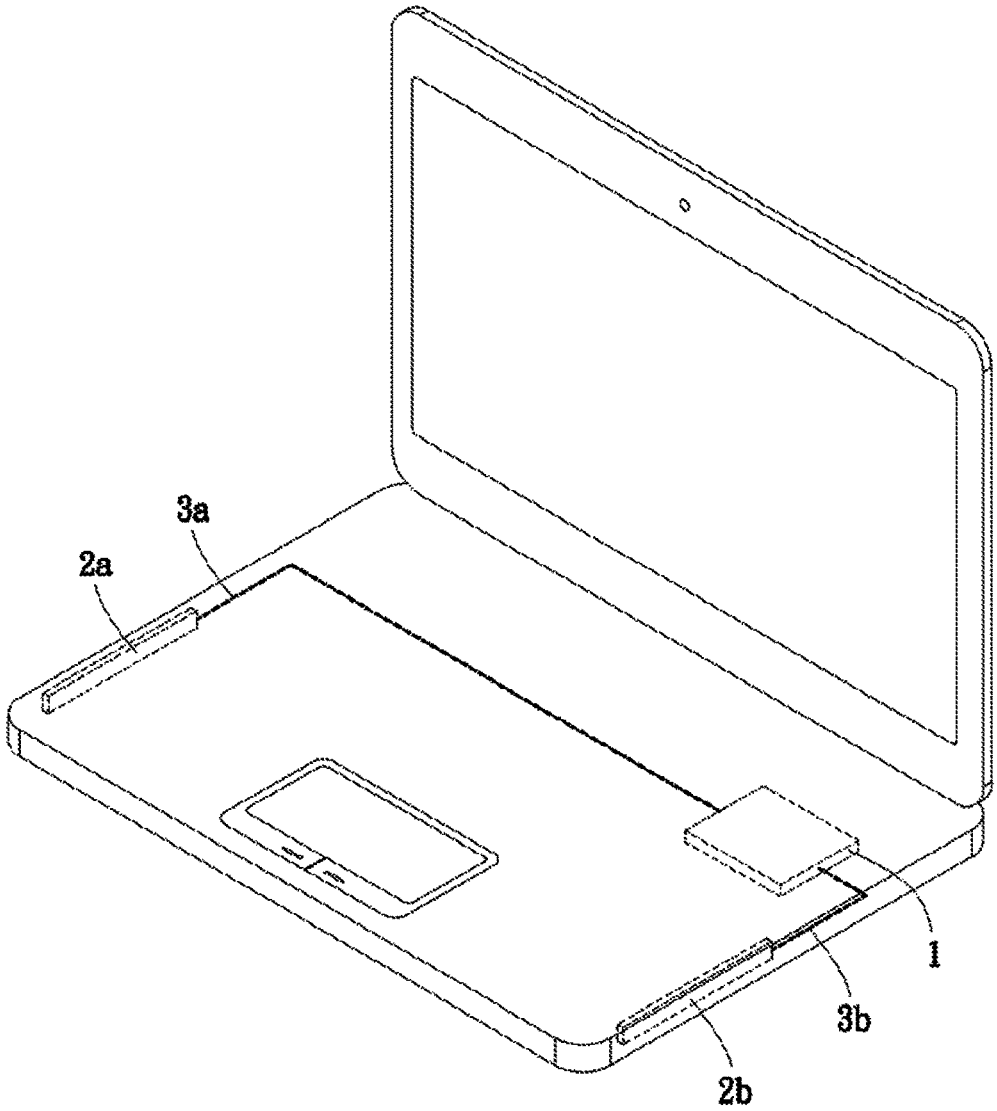
FIG. 3 (PRIOR ART)
FIG. 3 is a schematic of a conventional embedded antenna for laptop.
Figure 4:
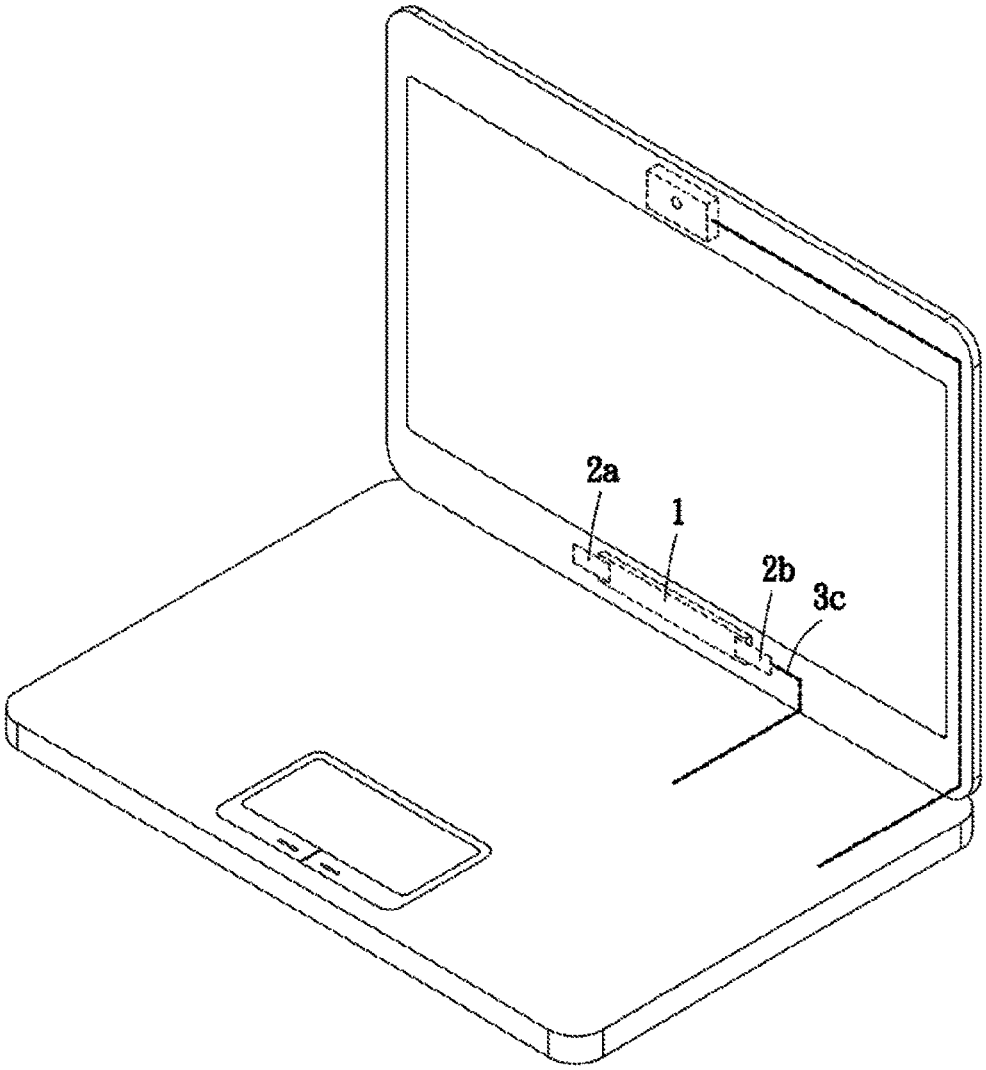
FIG. 4 (PRIOR ART)
FIG. 4 is a schematic of a conventional embedded antenna and camera for laptop.
Figure 5A:
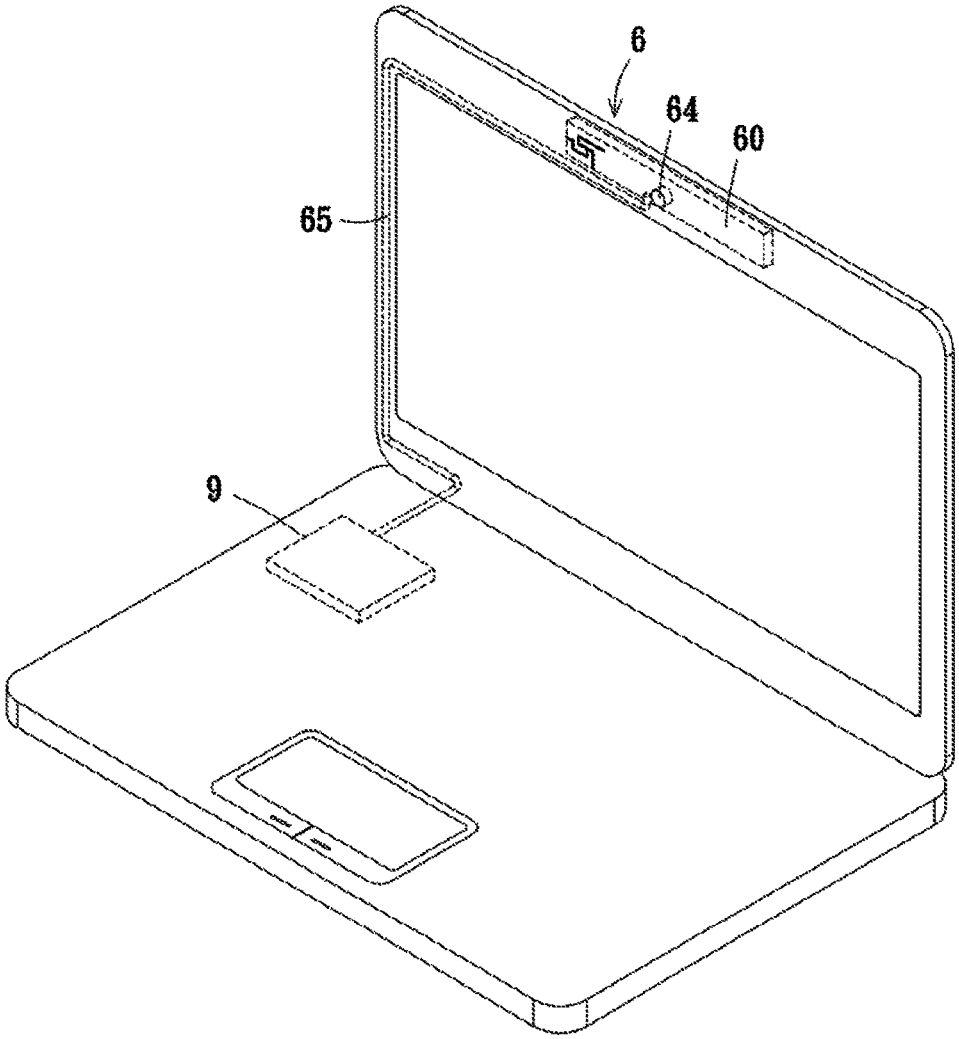
FIG. 5A is a schematic of an integrated module having an antenna disposed at the position above the screen of the laptop in one embodiment of the disclosure.

Please refer to FIG. 5A, which is a schematic of an integrated module having an antenna disposed on the upper side of the screen of the laptop in one embodiment of the disclosure. The integrated module having an antenna 6 is installed in the casing of the laptop, and only the camera of the camera module 64 is exposed on the casing. Explicitly, the integrated module having an antenna 6 includes a module substrate 60, a camera module 64 and a first antenna 61. The camera module 64 is disposed on the module substrate 60 and has a camera. The first antenna 61 is disposed on the module substrate 60. The ground plane 7 of module substrate 60 is connected with the system ground of the laptop. The module substrate 60 is, for example, a microwave substrate or a printed circuit board. The first antenna 61 is, for example, printed or etched on the surface of the module substrate 60. When the integrated module having an antenna 6 does not include a wireless module, the signal line 65 includes radiofrequency signal line such as co-axial cable for transmitting the radiofrequency signal of the first antenna 61 and the digital signal line of the camera module 64 for connecting with the system circuit 9 of the laptop. Further, when the wireless module (not shown) is also integrated in the integrated module having an antenna 6, and the signal line 65 may only include the digital signal line. Not only the signal connection between the system circuit 9 and the camera module 64 but also the signal communication between the system circuit 9 and the wireless module is provided.

Figure 5B:
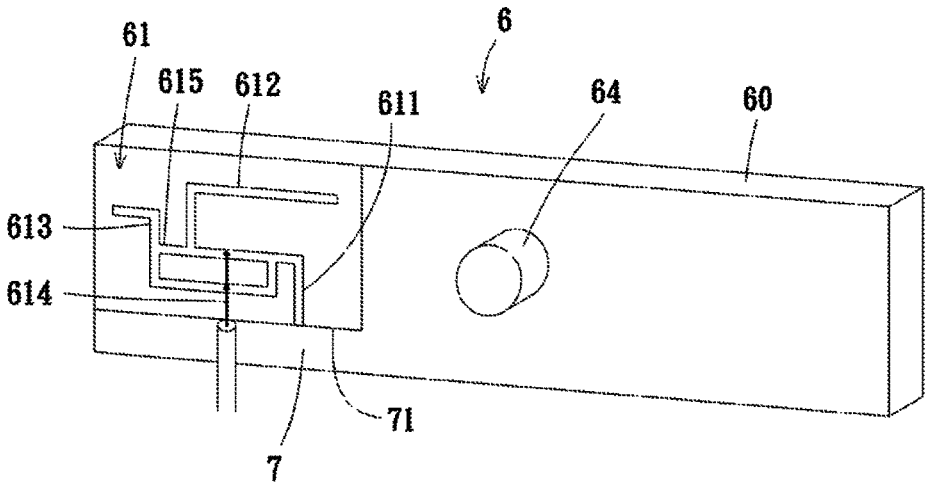
FIG. 5B is a schematic of an integrated module having an antenna in one embodiment of the disclosure.

Then, please refer to FIG. 5B, which is a schematic of an integrated module having an antenna in one embodiment of the disclosure. In FIG. 5B, the signal line 65 in FIG. 5A connected to the integrated module having an antenna 6 is omitted. The first antenna 61 includes a first grounding portion 611, a first low-frequency radiating arm 612, a first high-frequency radiating arm 613, a first feed-in line 614 and a first shorting portion 615. In the embodiment of FIG. 5B, the length of the first low-frequency radiating arm 612 is larger than the length of the first high-frequency radiating arm 613. The first grounding portion 611, the first low-frequency radiating arm 612, the first high-frequency radiating arm 613, and the first shorting portion 615 are all on the same plane and disposed on the same surface of the module substrate 60. The first feed-in line 614 is used for connecting the antenna 61 and the wireless module which is not shown in FIG. 5B. The first feed-in line 614 is electrically connected to the first low-frequency radiating arm 612 and the first high-frequency radiating arm 613 by tin-welding when the integrated module having an antenna 6 is assembled. In one embodiment, the first feed-in line 614 is the core wire of the co-axial cable and the outer conductor of the co-axial cable is connected to the ground plane 7. However, the implementation of the first feed-in line 614 should not be limited by the disclosure.

Figure 6:
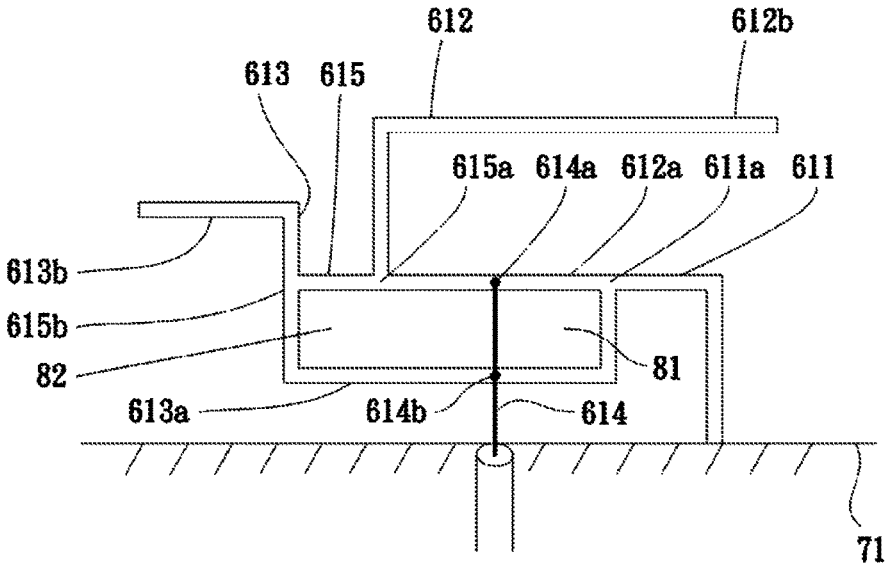
FIG. 6 is a schematic of the first antenna of the integrated module having an antenna in one embodiment of the disclosure.

Then, please refer to FIG. 6. The structure of the first antenna 61 will be illustrated in advance in the following paragraph, wherein, for the sake of illustration, the first side 71 of the ground plane 7 is simplified as a straight line, and the other side of the ground plane 7 in the right side of the first side 71 of the ground plane 7 in FIG. 5B is omitted. Further, the variation of the shape of the ground plane 7 is no taken into consideration in the following illustration. The first grounding portion 611 is connected to the first side 71 of the ground plane 7. first low-frequency radiating arm 612 has a first connection portion 612*a* and a first free-end portion 612*b*, wherein the first connection portion 612*a* is connected to the end 611*a* of the first grounding portion 611. The first high-frequency radiating arm 613 has a second connection portion 613*a* and a second free-end portion 613*b*, wherein the second connection portion 613*a* is connected to the end 611*a* of the first grounding portion 611. The second free-end portion 613*b* of the first high-frequency radiating arm 613 and the first free-end portion 612*b* of the first low-frequency radiating arm 612 are back to each other and extending toward opposite directions. In FIG. 6, the first free-end portion 612*b* of the first low-frequency radiating arm 612 extends to the right side of FIG. 6, and the second free-end portion 613*b* of the first high-frequency radiating arm 613 extends to the left side of FIG. 6. The first feed-in line 614 is perpendicular to the first side 71 of the ground plane 7 and extending to the direction away from the ground plane 7. In FIG. 6, the first low-frequency radiating arm 612 starts from the first connection portion 612*a* and extends to the first free-end portion 612*b*. Further, the first free-end portion 612*b* has a folding portion extending upwards and then folded with 90 degree to extend to the right side, but the present disclosure does not intend to limit the shape. The first free-end portion 612*b* may also have more than one folding portion such as two or more folding portions, and the shape of the first free-end portion 612*b* should not be limited therefore. The first high-frequency radiating arm 613 starts from the second connection portion 613 a and extends to the second free-end portion 613*b*, and the second free-end portion 613*b* has a folding portion extending upwards and then folded with 90 degree to extend to the left side, but the present disclosure does not intend to limit the shape. The second free-end portion 613*b* may also have more than one folding portion such as two or more folding portions, and the shape of the second free-end portion 613*b* should not be limited therefore.

Then, as to the feed-in of the first antenna 61, the two feeding-points provided by the first feed-in line 614 are the first feeding-point 614*a* and the second feeding-point 614*b*, respectively. The first feeding-point 614*a* and the second feeding-point 614*b* are connected to the first connection portion 612*a* of the first low-frequency radiating arm 612 and the second connection portion 613*a* of the first high-frequency radiating arm 613, respectively. Further, the end of the first feed-in line 614 is the position of the first feeding-point 614*a*. Explicitly, the first feed-in line 614 is cross and connected to the second connection portion 613*a* of the first high-frequency radiating arm 613 so as to provide the second feeding-point 614*b*, and the end of the first feed-in line 614 is connected to the first connection portion 612 of the first low-frequency radiating arm 612 so as to provide the first feeding-point 614*a*. The first shorting portion 615 has a first terminal 615*a* and a second terminal 615*b*. The first terminal 615*a* of the first shorting portion 615 is connected to a junction between the first free-end portion 612*b* and the first connection portion 612*a* of the first low-frequency radiating arm 612. The second terminal 615*b* of the first shorting portion 615 is connected to a junction between the second free-end portion 613*b* and the second connection portion 613*a* of the first high-frequency radiating arm 613.

Further, please refer to FIG. 6. The grounding portion 611 is substantially shaped as inverted L. The first connection portion 612*a* of the first low-frequency radiating arm 612 is parallel to the first side 71 of the ground plane 7, and at least a portion of the second connection portion 613*a* of the first high-frequency radiating arm 613 is parallel to the first side 71 of the ground plane 7. The second connection portion 613*a* of the first high-frequency radiating arm 613 has a folding portion. The second connection portion 613*a* is starting from the end 611*a* of the grounding portion 611 and extending to the first side 71 of the ground plane 7, and then folded with 90 degree to be parallel to the first side 71, and another 90 degree folding to extend away from the first side 71 of the ground plane 7. In other words, the second connection portion 613*a* of the first high-frequency radiating arm 613 is substantially U-shaped, and at least a portion of the second connection portion 613*a* of the first high-frequency radiating arm 613 is parallel to the first side 71 of the ground plane 7. However, the disclosure does not intend to limit the shape of the second connection portion 613*a*.

In the embodiment, a distance between the first connection portion 612*a* of the first low-frequency radiating arm 612 and the first side 71 of the ground plane 7 is larger than a distance between the second connection portion 613*a* of the first high-frequency radiating arm 613 and the first side 71 of the ground plane 7. Simply speaking, the first connection portion 612*a* of the first low-frequency radiating arm 612 is farer from the ground plane 7 than the second connection portion 613*a* of the first high-frequency radiating arm 613, and the first connection portion 612*a* of the first low-frequency radiating arm 612 and the portions of the second connection portion 613*a* of the first high-frequency radiating arm 613 connected to the first feed-in line 614, which are around the first feeding-point 614*a* and the second feeding-point 614*b*, are substantially perpendicular to the first feed-in line 614 so that a distance between the first feeding-point 614*a* and the first side 71 of the ground plane 7 is larger than a distance between the second feeding-point 614*b* and the first side 71 of the ground plane 7.

Further, when a signal is fed into the first antenna 61, the integrated module having an antenna 6 may be firstly installed into a specific position of the laptop, such as a position above the screen in FIG. 5A. Then, the feed-in positions, including the first feeding-point 614*a* and the second feeding-point 614*b*, are selected to make the low-frequency bandwidth of the first low-frequency radiating arm 612 meet the required range of operating frequency such as the range with center frequency of 2.4 GHz, and to make the high-frequency bandwidth of the first high-frequency radiating arm 613 meet the required range of operating frequency such as the range including 5 GHz. Conventionally, for different structure of a variety of types of laptops, one antenna structure may have its operating frequency shifted when assembled in different type of laptop, so the manufacturer has to modify each operating frequency. For example, the bandwidth of 2.4 GHz and the bandwidth of 5 GHz have to be modified, so the complexity of design of product and manufacture of product increase. Moreover, the antenna structure has to be modified. Compared with the conventional design, the first feed-in line 614 in the embodiment of the disclosure provides signal feed-in for the first low-frequency radiating arm 612 and the first high-frequency radiating arm 613, so it's simpler and easier to assemble and modify the frequency of the antenna.

Further, the first shorting portion 615 and the first grounding portion 611 are on the two sides of the first feed-in line 614, respectively. The first shorting portion 615, the first connection portion 612*a* of the first low-frequency radiating arm 612 and the second connection portion 613*a* of the first high-frequency radiating arm 613 enclose a feeding adjustment area, the first feed-in line 614 divides the feeding adjustment area into a first close area 81 and a second close area 82, such that an intermediate portion of the first feed-in line 614 between the first feeding-point 614*a* and the second feeding-point 614*b*, the first connection portion 612*a*, and the second connection portion 613*a* together enclose the first close area 81. The intermediate portion of the first feed-in line 614 between the first feeding-point 614*a* and the second feeding-point 614*b*, the shorting portion 615, the first connection portion 612*a*, and the second connection portion 613*a* together enclose the second close area 82.

Figure 7:
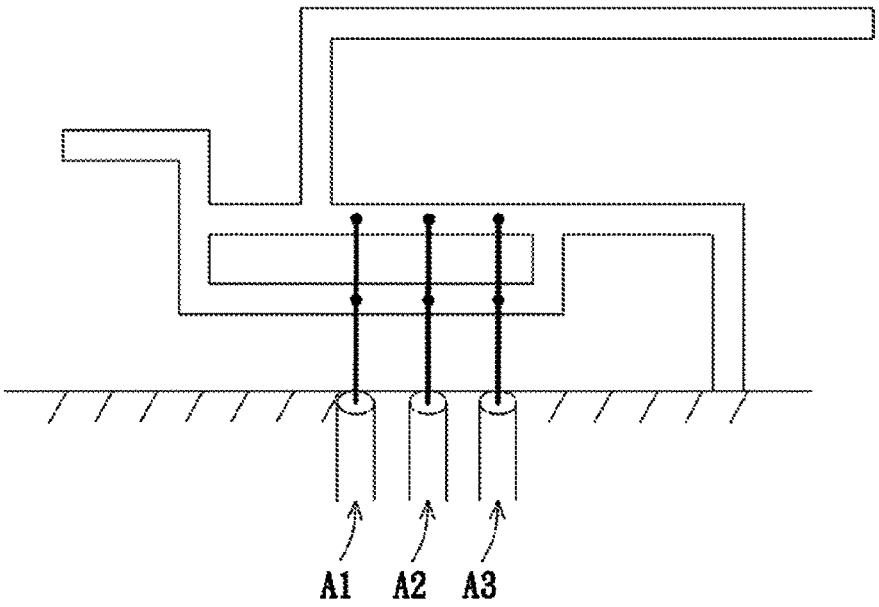
FIG. 7 is a schematic of an integrated module having an antenna with different feeding-point in another embodiment of the disclosure.
Figure 8:
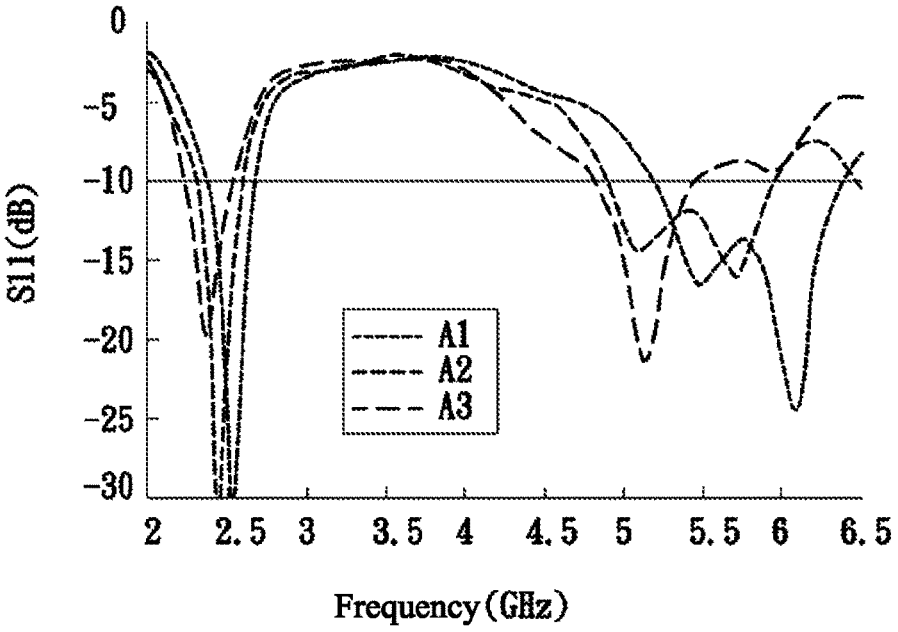
FIG. 8 is a schematic of S11 parameter to frequency diagram corresponding to the feeding-point selections in FIG. 7.

In practice, the first feed-in line 614 may be shifted horizontally toward the grounding portion 611 or the shorting portion 615. Hence, as shown in FIG. 7, the first feed-in line 614 may be shifted to the position A1, the position A2 or the position A3. Please refer to the S11 parameter diagrams in FIG. 8 for example, with the same structure of the first antenna 61, the central frequencies of the low-frequency bandwidth corresponding to the conditions when the first feed-in line 614 is shifted to the position A1, the position A2, and the position A3 are 2.52 GHz, 2.45 GHz, and 2.39 GHz, respectively. Additionally, the bandwidth of −10 dB impedance of each of the embodiments reaches 280 MHz to 310 MHz, so there is effect of frequency tuning. Additionally, the central frequencies of the high frequency bandwidth are 5.78 GHz with 1.2 GHz bandwidth of −10 dB impedance, 5.43 GHz with 1.0 GHz bandwidth of −10 dB impedance, and 5.13 GHz with more than 600 MHz bandwidth of −10 dB impedance, respectively. As above, when the feed-in line is shifted toward the grounding portion 611 such as the position A3, both of the operating frequencies of the first low-frequency radiating arm 612 and the first high-frequency radiating arm 613 are decreased. It is because the current path from the feeding-point 614*a* or 614*b* to the free-end portion 612*b* or 613*b* is increased and the exciting frequency is decreased. On the contrary, when the feed-in line is shifted toward the shorting portion 615 such as the position A1, both of the operating frequencies of the first low-frequency radiating arm 612 and the first high-frequency radiating arm 613 are increased. It is because the current path from the feeding-point 614*a* or 614*b* to the free-end portion 612*b* or 613*b* is decreased and the exciting frequency is increased.

Figure 9A:
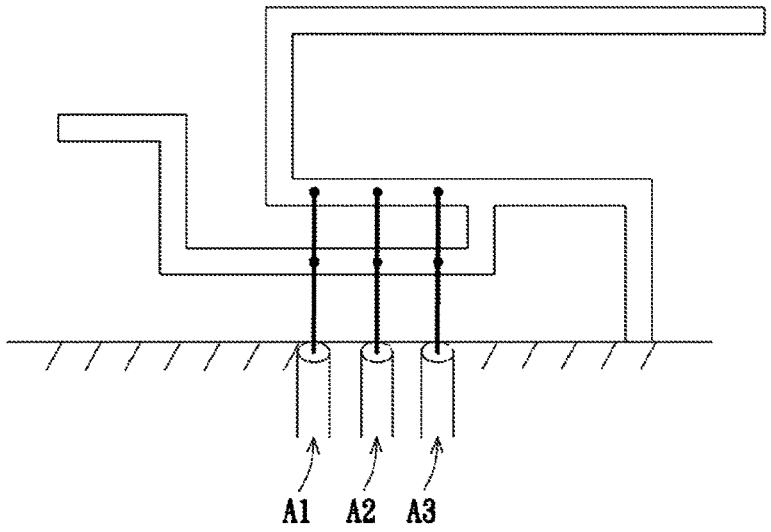
FIG. 9A is a schematic of an antenna without the shorting portion and with different feeding-points in FIG. 6.
Figure 9B:
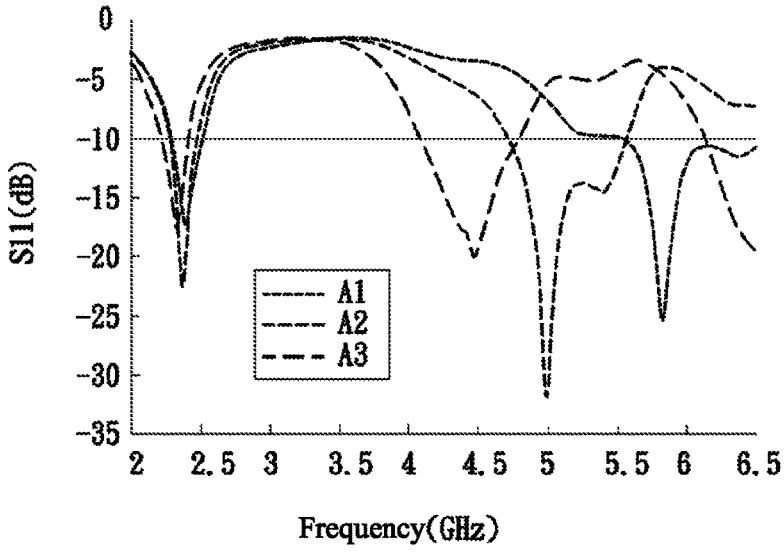
FIG. 9B is a schematic of S11 parameter to frequency diagram corresponding to the antennas with different feeding-points in FIG. 9A.

Further, the shorting portion 615 in the embodiment of the disclosure provides the effect of restraining the high-frequency shifting, and it largely improves the convenience of adjusting the high-frequency and the low-frequency at the same time. Simply, as to the purpose of adjusting the frequency, when the position of the feed-in line is shifted with a certain distance d, it leads to different amounts of shifting for the high-frequency operation and for the low-frequency operation. For example, as to 2.4 GHz excited by the first low-frequency radiating arm 612 and 5 GHz excited by the first high-frequency radiating arm 613, the frequency shifting corresponding to 5 GHz is obviously larger than that corresponding to 2.4 GHz when the position of the feed-in line is shifted with the certain distance d, and it results in the problem that it's hard to maintain both of the high frequency operation and the low frequency operation. As shown in FIG. 9A, the S11 parameters without the shorting portion 615 are shown in the comparative FIG. 9B. When the position of the feed-in line is at the position A1, the central frequency of the low frequency is 2.41 GHz and the central frequency of the high frequency is 6.01 GHz. When the position of the feed-in line is at the position A2, the central frequency of the low frequency is 2.38 GHz and the central frequency of the high frequency is 5.14 GHz. When the position of the feed-in line is at the position A3, the central frequency of the low frequency is 2.32 GHz and the central frequency of the high frequency is 4.44 GHz. It shows that the shift of the high frequency operation is too large. It's known that when the position of the feed-in line is adjusted to fine tune the low frequency, the high frequency operation is shifted largely and hard to be fine-tuned. Similarly, if the amount of shifting of the feed-in line is decreased, the high frequency may be fine-tuned as needed but the low frequency might remain unchanged. As above, the high frequency and the low frequency are hard to be achieved by modifying one parameter in the conventional design. It means that the adjustments of the high frequency and the low frequency are hard to be achieved once. Hence, the adjustment of the low frequency and the adjustment of the high frequency are usually distinguished in conventional design to avoid the complicated conditions. As above, compared with the conventional design concept, the embodiment of the disclosure makes the junction between the first free-end portion 612*b* and the first connection portion 612*a* of the first low-frequency radiating arm 612 and the junction between the second free-end portion 613*b* and the second connection portion 613*a* of the first high-frequency radiating arm 613 short by the shorting portion 615, so the amount of variation of the frequency corresponding to the first high-frequency radiating arm 613 is suppressed and the purpose of adjusting the low frequency (2.4 GHz) and the high frequency (5 GHz) easily at the same time is achieved.

Further, the camera module 64 and the first antenna 61, even the wireless module, are integrated in the integrated module having an antenna 6. In the procedure of manufacturing the product, and it's only needed to assemble the integrated module having an antenna 6 into the laptop, and to adjust the position of the feed-in line of the first antenna 61 simply, and one integrated module having an antenna 6 may be applied in a variety of types of laptops. The dual-bandwidth with 2.4 GHz and 5 GHz is achieved and the purpose of module assemble and cost reduction are also achieved.

Figure 10:
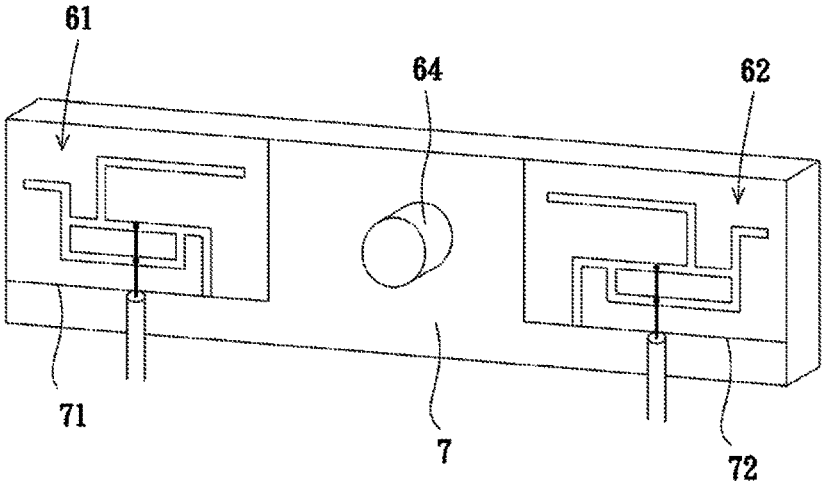
FIG. 10 is a schematic of an integrated module having an antenna in another embodiment of the disclosure.
Figure 11:
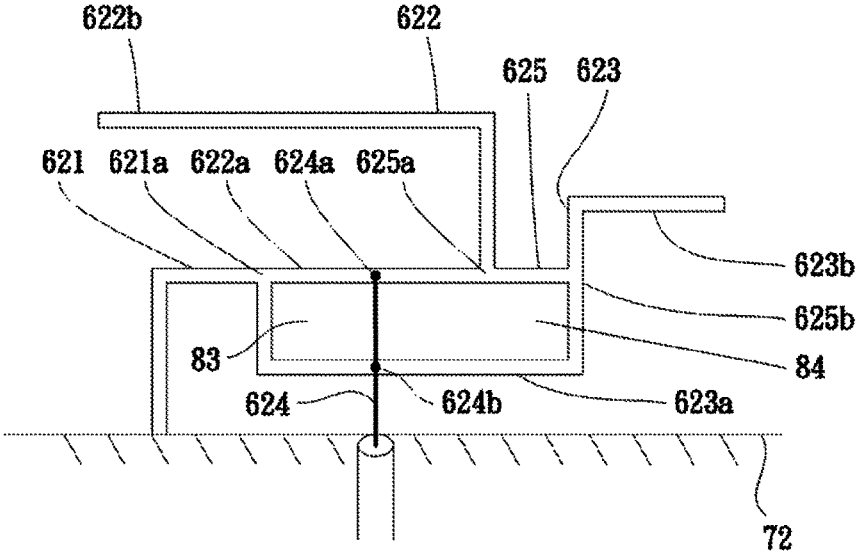
FIG. 11 is a schematic of a second antenna of the integrated having an antenna in FIG. 10.

Then, please refer to FIG. 10, which is a schematic of an integrated module having an antenna according to another embodiment of the disclosure. Compared with the embodiment in FIG. 5B, the integrated module having an antenna in the embodiment in FIG. 10 further has a second antenna 62 in addition to the first antenna 61. The structure of the first antenna 61 and the structure of the second antenna 62 are mirror to each other, but the disclosure does not intent to limit the structure thereof. The design concept of the second antenna 62 is substantially the same as that of the first antenna 61. The structure of the second antenna 62 is shown in FIG. 11. Explicitly, the second antenna 62 includes a second grounding portion 621, a second low-frequency radiating arm 622, a second high-frequency radiating arm 623, a second feed-in line 624, and a second shorting portion 625. The second grounding portion 621, the second low-frequency radiating arm 622, the second high-frequency radiating arm 623, and the second shorting portion 625 are on the same plane and printed on the same surface of the module substrate 60. The second grounding portion 621 is connected to the second side 72 of the ground plane 7. The second low-frequency radiating arm 622 has a third connection portion 622*a* and a third free-end portion 622*b*, wherein the third connection portion 622*a* is connected to the end 621*a* of the second grounding portion 621. The second grounding portion 621 is, for example, shaped inverted-L. The second high-frequency radiating arm 623 has a fourth connection portion 623*a* and a fourth free-end portion 623*b*, wherein the fourth connection portion 623*a* is connected to the end 621*a* of the second grounding portion 621. The fourth free-end portion 623*b* of the second high-frequency radiating arm 623 and the third free-end portion 622*b* of the second low-frequency radiating arm 622 are back-to-back and extending toward opposite directions. The second feed-in line 624 is perpendicular to the second side 72 of the ground plane 7 and extending toward a direction away from the ground plane 7, and is used for providing a third feeding-point 624*a* and a fourth feeding-point 624*b*. The second feed-in line 624 is cross and connected to the fourth connection portion 623*a* of the second high-frequency radiating arm 623 to provide the fourth feeding-point 624*b*, and the end of the second feed-in line 624 is connected to the third connection portion 622*a* of the second low-frequency radiating arm 622 to provide the third feeding-point 624*a*. The second shorting portion 625 has a first terminal 625*a* and a second terminal 625*b*, wherein the first terminal 625*a* of the second shorting portion 625 is connected to a junction between the third free-end portion 622*b* and the third connection portion 622*a* of the second low-frequency radiating arm 622, and the second terminal 625*b* of the second shorting portion 625 is connected to a junction between the fourth free-end 623*b* and the fourth connection portion 623*a* of the second high-frequency radiating arm 623. A distance between the third feeding-point 624*a* and the second side 72 of the ground plane 7 is larger than a distance between the fourth feeding-point 624*b* and the second side 72 of the ground plane 7. The second shorting portion 625 and the second grounding portion 621 are on the two sides of the second feed-in line 624. The second shorting portion 625, the third connection portion 622*a* of the second low-frequency radiating arm 622 and the fourth connection portion 623*a* of the second high-frequency radiating arm 623 enclose a feeding adjustment area, the second feed-in line 624 divides the feeding adjustment area into a third close area 83 and a fourth close area 84, such that an intermediate portion of the second feed-in line 624 between the third feeding-point 624*a* and the fourth feeding-point 624*b*, the third connection portion 622*a*, and the fourth connection portion 623*a* enclose the third close area 83. The intermediate portion of the second feed-in line 624 between the third feeding-point 624*a* and the fourth feeding-point 624*b*, the second shorting portion 625, the third connection portion 622*a*, and the fourth connection portion 623*a* enclose the fourth close area 84.

As above, the integrated module having an antenna provided in one embodiment of the disclosure uses the first shorting portion or the second shorting portion to achieve that the low-frequency operating frequency and the high-frequency operating frequency of the antenna may be adjusted at the same time by adjusting the position of the first feed-in line or the second feed-in line perpendicular to the first side of the ground plane or the second side of the ground plane. Hence, the antenna structure of the integrated module of the same spec may be applied in a variety of types of laptop without modifying the integrated module or the antenna structure, so the product cost may be largely reduced. In addition, the integrated module having an antenna is easy to be installed, and the antenna structure and the camera module are integrated so the component cost and the manufacture cost are also reduced.

What is claimed is:

1. An integrated module having an antenna, comprising:

a module substrate;

a camera module disposed on the module substrate and having a camera; and a first antenna disposed on the module substrate, wherein the first antenna comprises:

a first grounding portion connected to a first side of a ground plane;

a first low-frequency radiating arm having a first connection portion and a first free-end portion, wherein the first connection portion is connected to the first grounding portion;

a first high-frequency radiating arm having a second connection portion and a second free-end portion, wherein the second connection portion is connected to the first grounding portion, and the second free-end portion of the first high-frequency radiating arm and the first free-end portion of the first low-frequency radiating arm are back-to-back and extend to opposite directions;

a first feed-in line perpendicular to the first side of the ground plane, extending toward a direction away from the ground plane, and used for providing a first feeding-point and a second feeding-point, wherein the first feed-in line crosses and connects with the second connection portion of the first high-frequency radiating arm to provide the second feeding-point, and an end of the first feed-in line is connected to the first connection portion of the first low-frequency radiating arm so as to provide the first feeding-point; and a first shorting portion having a first terminal and a second terminal, wherein the first terminal of the first shorting portion is connected to a junction between the first free-end portion and the first connection portion of the first low-frequency radiating arm, and the second terminal of the first shorting portion is connected to a junction between the second free-end portion and the second connection portion of the first high-frequency radiating arm.

2. The integrated module having an antenna in claim 1, wherein, the first feed-in line is a core wire of a co-axial cable and an outer conductor of the co-axial cable is connected to the ground plane.

3. The integrated module having an antenna in claim 1, wherein, a distance between the first feeding-point and the first side of the ground plane is larger than a distance between the second feeding-point and the first side of the ground plane.

4. The integrated module having an antenna in claim 1, wherein the first connection portion of the first low-frequency radiating arm is parallel to the first side of the ground plane, and at least part of the second connection portion of the first high-frequency radiating arm is parallel to the first side of the ground plane, and a shortest distance between the first connection portion of the first low-frequency radiating arm and the first side of the ground plane is larger than a shortest distance between the second connection portion of the first high-frequency radiating arm and the first side of the ground plane.

5. The integrated module having an antenna in claim 1, wherein the first shorting portion and the first grounding portion are at two sides of the first feed-in line, respectively.

6. The integrated module having an antenna in claim 1, wherein the first shorting portion, the first connection portion of the first low-frequency radiating arm and the second connection portion of the first high-frequency radiating arm enclose a feeding adjustment area, the first feed-in line divides the feeding adjustment area into a first close area and a second close area, such that an intermediate portion of the first feed-in line between the first feeding-point and the second feeding-point, the first connection portion and the second connection portion enclose the first close area, and the intermediate portion of the first feed-in line between the first feeding-point and the second feeding-point, the shorting portion, the first connection portion and the second connection portion enclose a second close area.

7. The integrated module having an antenna in claim 1, wherein the first grounding portion, the first low-frequency radiating arm, the first high-frequency radiating arm, and the first shorting portion are all on one surface of the module substrate and on one plane.

8. The integrated module having an antenna in claim 1, further comprising a second antenna which comprises:

a second grounding portion connected to a second side of the ground plane;

a second low-frequency radiating arm having a third connection portion and a third free-end portion, wherein the third connection portion is connected to the second grounding portion;

a second high-frequency radiating arm having a fourth connection portion and a fourth free-end portion, wherein the fourth connection portion is connected to the second grounding portion, and the fourth free-end portion of the second high-frequency radiating arm and the third free-end portion of the second low-frequency radiating arm are back-to-back and extending towards opposite directions;

a second feed-in line perpendicular to the second side of the ground plane and extending towards a direction away from the ground plane, and used for providing a third feeding-point and a fourth feeding-point, wherein the second feed-in line is cross and connected to the fourth connection portion of the second high-frequency radiating arm to provide the fourth feeding-point, and an end of the second feed-in line is connected to the third connection portion of the second low-frequency radiating arm to provide the third feeding-point; and a second shorting portion having a first terminal and a second terminal, wherein the first terminal of the second shorting portion is connected to a junction between the third free-end portion and the third connection portion of the second low-frequency radiating arm, and the second terminal of the second shorting portion is connected to a junction between the fourth free-end portion and the fourth connection portion of the second high-frequency radiating arm;

wherein a distance between the third feeding-point and the second side of the ground plane is larger than a distance between the fourth feeding-point and the second side of the ground plane, and the second shorting portion and the second grounding portion are at two sides of the second feed-in line, respectively.

9. The integrated module having an antenna in claim 8, wherein a structure of the first antenna and a structure of the second antenna are mirrored to each other.

10. The integrated module having an antenna in claim 8, wherein the second grounding portion, the second low-frequency radiating arm, the second high-frequency radiating arm, and the second shorting portion are all on the same plane and printed on a surface of the module substrate.

* * * * *